United States Patent [19]

Reist

[11] 4,229,134

[45] Oct. 21, 1980

[54] APPARATUS FOR DISPLACING THREE DIMENSIONAL ARTICLES, ESPECIALLY STACKS OF PRINTED PRODUCTS

[75] Inventor: Walter Reist, Hinwil, Switzerland

[73] Assignee: Ferag AG, Hinwil, Switzerland

[21] Appl. No.: 949,515

[22] Filed: Oct. 10, 1978

[30] Foreign Application Priority Data

Oct. 24, 1977 [CH] Switzerland ..... 12893/77
Nov. 29, 1977 [CH] Switzerland ..... 14565/77

[51] Int. Cl.[3] ..... B65H 31/30

[52] U.S. Cl. ..... 414/46; 198/485; 198/747; 254/DIG. 6

[58] Field of Search ..... 414/17, 18, 19, 31, 414/43, 46, 89, 214; 198/485, 747; 254/DIG. 6

[56] References Cited

U.S. PATENT DOCUMENTS

| | | | |
|---|---|---|---|
| 2,956,381 | 10/1960 | Chauvin et al. | 414/46 X |
| 3,115,090 | 12/1963 | Elander | 414/46 X |
| 3,599,807 | 8/1971 | Hedrick et al. | 414/46 X |
| 3,640,407 | 2/1972 | Anastasio et al. | 414/46 X |
| 3,746,190 | 7/1973 | Hotz | 254/DIG. 6 |
| 3,757,514 | 9/1973 | Reist | 59/78 |
| 3,809,253 | 5/1974 | Mercer | 414/18 |
| 4,068,567 | 1/1978 | Allison et al. | 414/46 X |

*Primary Examiner*—L. J. Paperner
*Attorney, Agent, or Firm*—Werner W. Kleeman

[57] ABSTRACT

An apparatus for ejecting stacks of flat products, especially printed products from a receiver chute of a stacker device. The stack supported upon a support table which closes the receiver chute at its lower end is displaced by means of a forward and rearward movable ejection element from the support table. The ejection element is secured to one end of a flexible, spatially movable thrust and traction element, for instance a ball-and-socket chain. At the other end of the thrust and traction element there engages a drive unit, for instance an hydraulic or pneumatic piston-and-cylinder unit. The thrust and traction element is guided by a guide having a stationary part and a section which travels in the support table which changes its position. In a rest position of the support table the section travelling in the support table is in alignment with the stationary part of the guide. During its displacement over the support table the ejection element bears at the support table, preferably by means of rolls.

11 Claims, 2 Drawing Figures

APPARATUS FOR DISPLACING THREE DIMENSIONAL ARTICLES, ESPECIALLY STACKS OF PRINTED PRODUCTS

BACKGROUND OF THE INVENTION

The present invention relates to a new and improved construction of apparatus for displacing three dimensional articles, especially stacks of printed products, relative to a horizontal support element which is changeable in its position.

The apparatus of the invention is of the type comprising a thrust or pusher element exerting a thrust or pushing action upon the articles which are to be displaced, the thrust or pusher element can be moved by means of a drive device forwards and backwards parallel to the support element over such support element. Such apparatus is preferably used for ejecting stacks of flat articles or products, especially printed products, from a receiver chute of a stacker device and which receiver chute is closed at its lower end or bottom by the support element.

With a heretofore known apparatus of this type, as disclosed in German Patent publication No. 1,951,506 the thrust of pusher element is attached to a horizontal thrust or push rod driven to carry out to-and-fro movements. This thrust rod carries and guides the thrust element, and therefore, requires a correspondingly sturdy mounting of the thrust rod. In order to be able to displace the thrust element over the entire length of the support table, the thrust rod has an appropriate length so that it laterally protrudes to a considerable extent past the housing of the equipment. In the event that the thrust rod is not employed for supporting and guiding the thrust element, then, there must be provided a separate guide for the thrust element. However, this results in a complicated construction.

SUMMARY OF THE INVENTION

Therefore, with the foregoing in mind, it is a primary object of the present invention to overcome the aforementioned drawbacks and limitations of the prior art proposals.

Another and more specific object of the present invention aims at devising an apparatus of the previously mentioned type having a simple, space saving and reliably operating drive device for the thrust element, without there being required complicated guides and mounting or support arrangements for the thrust element and without impairing the ability to change the position of the support element.

Still a further significant object of the present invention is directed to the provision of a new and improved construction of apparatus for displacing three dimensional articles, especially stacks of printed products, although not exclusively limited to such environment of use, in a highly efficient, reliable and accurate manner, which apparatus is relatively simple in construction and design, economical to manufacture, not readily subject to breakdown or malfunction, and requires a minimum of maintenance and servicing.

Now in order to implement these and still further objects of the invention, which will become more readily apparent as the description proceeds, the invention contemplates attaching the thrust element, which is supported during its displacement over the support element at such support element, at one end of a flexible, spatially movable thrust and traction element. The other end of this thrust and traction element is operatively connected with a drive unit or device. The thrust and traction element is guided by a guide means having a stationary part or section and at least one section travelling within the support element. This section which travels in the support element, in a rest position of the support element, can be brought into alignment with the stationary part or section.

Since, the thrust element is displaced by means of a flexible, spatially movable thrust and traction element, the course of the guide means of the thrust and traction element can be essentially randomly chosen. There is thus possible a space saving arrangement. Laterally protruding parts can be extensively avoided. The thrust and traction element, which is guided through a guide means extending into the support element, guides the thrust element secured thereto, during its displacement, over the support element. During this displacement the thrust element bears upon the support element, preferably by means of rolls or rollers. The inherent weight of the thrust element is thus taken-up by the support element. After a change of the position of the support element (rotation and/or elevational adjustment) there is thus not required a very exact positioning of the support element in its rest position, since the stationary section of the guide means and the section of the guide means arranged in the support element for the thrust and traction element only need be aligned relative to one another such that the thrust and traction element can be introduced from the stationary guide section into the guide section arranged in the support element. The inventive apparatus is simpler and easier than the heretofore proposed solution of the prior art.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
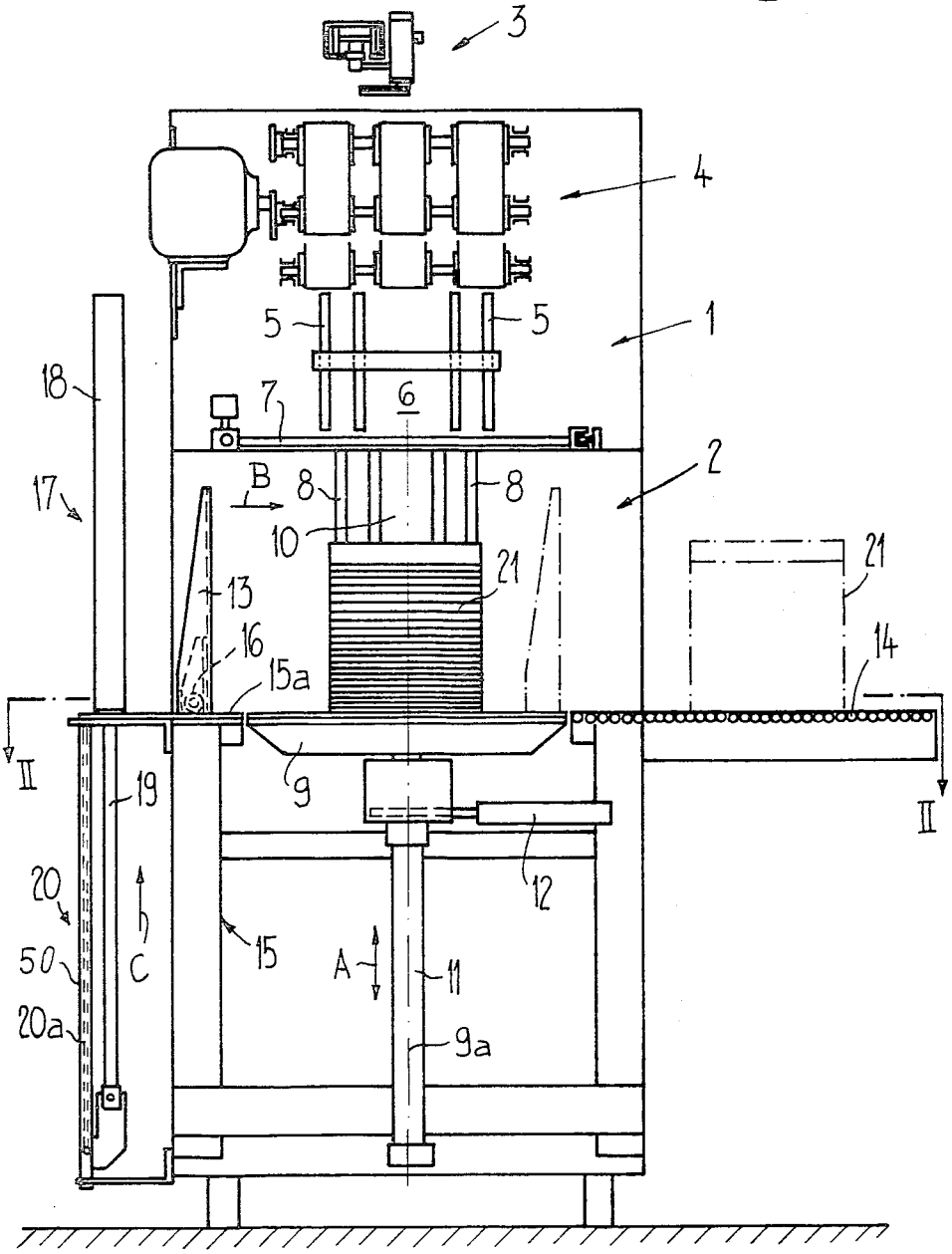
FIG. 1 is a front view of an apparatus for forming packages or bundles from stacks of folded printed products.
Figure 2:
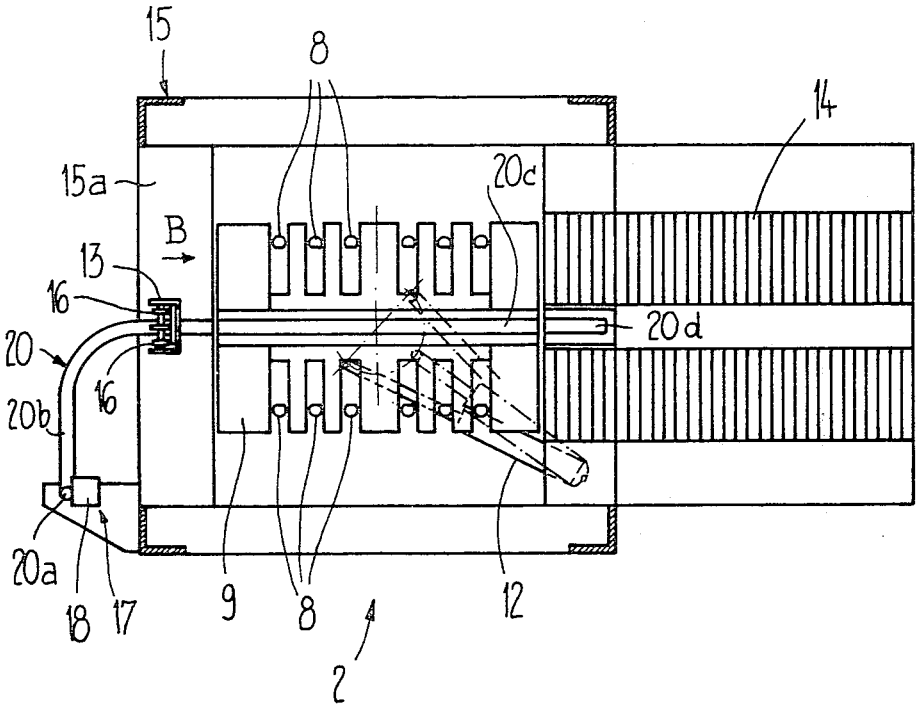
FIG. 2 is a sectional view of the arrangement of FIG. 1, taken substantially along the line II—II thereof.

Describing now the drawings, the apparatus, shown in the various FIGS. 1 and 2, serving for forming packages or bundles or crosswise-laid stacks of folded printed products, will be seen to comprise a stacker or stacking unit or device 1 and a package or bundle forming unit or device 2 arranged therebelow. The not particularly referenced folded printed products which are to be stacked are infed by a first conveyor device 3, received by a second conveyor device 4 and delivered to the stacker unit or device 1. Details of a possible construction of the stacker unit 1 and the nature of infeeding the printed products to the stacker unit 1 constitutes subject matter of the commonly assigned, copending U.S. application Ser. No. 855,357, filed Nov. 28, 1977, now abandoned, entitled "APPARATUS FOR STACKING FOLDED, CONTINUOUSLY ARRIVING PRINTED PRODUCTS, ESPECIALLY PRODUCTS ARRIVING IN AN IMBRICATED PRODUCT STREAM", U.S. application Ser. No. 855,412, filed Nov. 28, 1977, now U.S. Pat. No. 4,140,052, entitled "APPARATUS FOR COMPRESSING A STACK OF FOLDED, ESSENTIALLY FLAT PRODUCTS, ESPECIALLY PRINTED PRODUCTS", and U.S. application Ser. No. 949,516, filed Oct. 10, 1978, entitled "APPARATUS FOR DIVIDING A CONTINUOUS STREAM OF FLAT PRODUCTS, ESPECIALLY PRINTED PRODUCTS INTO INDIVIDUAL SECTIONS", to each of which applications reference may be readily had and the disclosure of which is incorporated herein by reference. Therefore, in the description to follow the stacker unit 1 will only be described to the extent necessary to fully appreciate the underlying principles and concepts of the present invention.

Continuing, the stacker unit 1 will be seen to comprise a vertical stacker space or compartment 6 whose geometry is defined by the boundary ledges 5 or equivalent structure. The printed products which are conveyed by the conveyor device 4 drop into the stacker space or compartment 6, and in such stacker compartment 6 there is formed a stack of printed products which bear against one another by means of their folds. At its lower end the stacker compartment 6—which also may be referred to as a stack or stacker chute—is closed by two displaceable slide plates 7, of which in FIG. 1 there has only been shown one such slide plate 7, these slide plates being movable away from and towards one another in opposite directions perpendicular to the plane of the drawings, in order to thus open and close, as the case may be, the stacker or stack compartment 6 at its lower end or region.

The package or bundle forming unit 2, details of which constitute the subject matter of the aforementioned U.S. application Ser. No. 855,412, filed Nov. 28, 1977, will be seen to comprise a receiver or receiving chute 10 for the individual stacks. The receiver chute 10 is formed by the guide ledges 8 or equivalent structure and a horizontal support table 9 defining a support element or support means. This support table 9 is secured at a lifting and lowering device 11, in other words an elevationally displaceable device, for instance constituted by a piston-and-cylinder unit, by means of which the support table 9 can be raised and lowered in the direction of the double-headed arrow A. Furthermore, a rotational or rotary drive device 12, for instance likewise constituted by a piston-and-cylinder unit, engages at the support table 9, and by means of this rotational device 12 it is possible to rotate the support table 9 through 180° about its lifting and lowering axis 9*a*.

Furthermore, as also seen from the showing of FIGS. 1 and 2, laterally of the support table 9 there is provided an ejection or ejector element 13 constructed by way of example as a rail member having a substantially C-shaped cross-section configuration. The ejection element 13, constituting a thrust or pusher element, can be displaced in the direction of the arrow B, from the full line end or terminal position shown in FIG. 1 into its broken line end or terminal position, when the table 9 is located in its rest position illustrated in FIG. 1. In this rest position the support table 9 together with its roller track 14 and a work surface 15*a* of a support frame 15 assume the same elevational position. In order to guide the ejection or ejector element 13 there are mounted thereat the rolls or rollers 16 or equivalent structure. The to-and-fro displacement of the ejection element 13 over the support table 9 is accomplished by a suitable drive, here shown in the form of a piston-and-cylinder unit 17, the cylinder 18 of which is vertically arranged for space saving reasons. At the piston rod 19 of the piston-and-cylinder unit 17 there is attached a flexible, spatially movable thrust and traction element, generally indicated by reference character 50 in FIG. 1, preferably a ball-and-socket joint chain, for instance of the type disclosed in German Patent publication No. 2,228,259 and the cognate U.S. Pat. No. 3,757,514, to which reference may be had and whose disclosure is incorporated herein by reference. The other end of the thrust and traction element 50 is attached at the ejection element 13. This thrust and traction element 50 travels within a guide tube 20 having a first section 20*a* which extends vertically upwardly from the end of the piston rod 19, as best seen by referring to FIG. 1, and a second section 20*b*, merging with the first section 20*a*, this second section 20*b* being curved and extending horizontally in the plane of travel of the ejection element 13, as best seen by referring to FIG. 2. In the support table 9 there is provided a third section 20*c* of the guide tube 20 or equivalent structure, which aligns with the tube section 20*b* when the support table 9 is located at its rest position at the same height as the roller or roll track 14 and the work surface 15*a*. At the third tube section 20*c* there merges a fourth end section 20*d* which is attached to the support frame 15. The guide tube sections 20*a*, 20*b* and 20*d* are stationary, whereas the section 20*c* moves together with the support table 9. The ejection element 9 which is located, in the showing of FIG. 1, in its left end or terminal position (rest position) bears upon the work surface 15*a* of the support frame 15 and is located externally of the path of movement of the support table 9, so that the elevational adjustability of the support table 9 is not impaired by the ejection element 13.

The described apparatus operates in the following manner: The printed products infed by the conveyor device 4, as mentioned, are stacked in the stacker compartment or chute 6 of the stacker unit or device 1. The finish stack is outfed by opening the slide plates 7 and delivered to the package or bundle forming unit 2. For the purpose of receiving the stack from the stacker compartment 6 the support table 9, prior to opening the slide plates 7, is raised to such an extent, with the table 9 still empty, that such table 9 or the package or bundle 21 reposing on the support table 9, come to lie directly below the slide plates 7, in order to thereby enable the stack to be transferred out of the stacker compartment 6 without having to drop through a larger path or displacement zone. After transfer of a stack has been accomplished, then, the slide plates 7 are again closed, so that a new stack can be formed within the stacker compartment 6. The support table 9 is now lowered to the extent needed, rotated through an angle of 180° by the rotational drive device or rotary device 12, and then again moved towards the closed slide plates 7, in order to press together the package or bundle 21 reposing upon the support table 9 against the slide plates 7, with the result that the printed product package or bundle 21 is compressed.

If a new stack is formed in the stacker compartment of chute 6, then the stack, in the already described manner, is deposited onto the compressed package or bundle which is reposing upon the support table 9. Since, as mentioned, the support table 9 has been rotated through 180°, the newly received stack comes to lie upon the previously received stack likewise turned through 180°. Due to this crosswise layering or stacking of the individual stacks there is thus formed, as the same is already known in this technology, a stable upright package or bundle 21 even if owing to greater thickness of the printed products at the fold edges the height of a stack at the one side of such fold edges is greater than at the oppositely situated side.

After the package or bundle 21 has reached the desired height, then, the support table 9 is brought into its rest position, shown in FIG. 1, where, as already mentioned, it is located with its roller track 14 and the work surface 15*a* at the same elevation. In order to eject the package or bundle 21 out of the receiver chute 10 there is now activated the piston-and-cylinder unit 17. The piston rod 19 is retracted in the direction of the arrow C, and thus, the ejection or ejector element 13 is displaced by means of the thrust and traction element in the direction of the arrow B over the support table 9. The package 21 is pushed away from the support table 9 by the ejection element 13 and on to the roller track 14, upon which this package 21 is then infed to the next processing station, for instance, the packaging or shipping station. Thereafter, by extending the piston rod 19 the ejection element 13 is moved back into its starting position. The support table 9 is thus ready for the renewed formation of a package of crosswise stacked or layered stacks. During its forward and rearward movement the ejection element 13 rolls over the support table 9 by means of its rollers or rolls 16. The linear guiding of the ejection element 13 is performed by the traction and tension element, which, during displacement of the ejection element 13, is supported in the support table 9, by the tube section 20*c*.

By means of the ejection element 13 it is possible to displace in the described manner also other three dimensional articles than packages of crosswise stacked printed products. It is equally possible to not only employ the ejection element for displacing three dimensional articles away from a support table, rather also for infeeding the articles to the support table.

Further, the support table 9 also can be designed only to be raisable and lowerable or only to be rotatable. It is moreover conceivable to provide in the support table 9 a number of sections 20*c* of the guide or guide means 20 for the thrust and traction element. Depending upon the rotational position of the support table 9 each time one of these sections can be brought into alignment with the stationary sections 20*a*, 20*b*, and 20*c*.

While there are shown and described present preferred embodiments of the invention, it is to be distinctly understood that the invention is lot limited thereto, but may be otherwise variously embodied and practiced within the scope of the following claims. Accordingly,

What I claim is:

1. An apparatus for displacing three dimensional articles, especially printed products, comprising:

a substantially horizontal, support element adjustable in its position;

a pusher element exerting a pushing action upon the articles to be displaced;

drive means for forwardly and rearwardly displacing the pusher element parallel to the support element and over said support element;

said pusher element, during its displacement over the support element, bearing upon said support element;

said drive means including a flexible, spatially movable thrust and traction element having a first end and a second end;

said pusher element being secured to said first end of said flexible, spatially movable thrust and traction element;

said drive means further including a drive unit connected with the other end of said flexible, spatially movable thrust and traction element;

guide means through which there is guided said flexible, spatially movable thrust and traction element;

said guide means having a stationary section and at least one section extending within the support element;

said at least one extending section, in a rest position of the support element from which the articles may be displaced, being alignable with the stationary section.

2. The apparatus as defined in claim 1, wherein:

said thrust and traction element comprises a ball-and-socket joint chain means.

3. The apparatus as defined in claim 1, wherein:

said guide means for the thrust and traction element comprises a guide tube.

4. The apparatus as defined in claim 1, wherein:

said pusher element is equipped with rolls;

said pusher element, during its displacement, moves by means of its rolls upon the support element.

5. The apparatus as defined in claim 1, further including:

means for elevationally adjusting the support element.

6. The apparatus as defined in claim 1, wherein:

said support element has a vertical axis; and the apparatus further comprises means for rotating said support element about said vertical axis.

7. The apparatus as defined in claim 6, wherein:

said support element has arranged therein a number of sections of said guide means for said thrust and traction element; and each of said number of sections, depending upon the rotational position of the support element, can be brought into alignment with the stationary section of the guide means.

8. The apparatus as defined in claim 1, wherein:

said apparatus is employed for ejecting stacks of flat articles, especially printed products, out of a receiver chute of a stacker device and which receiver chute is closed at its lower end by the support element.

9. The apparatus as defined in claim 1, wherein:

said drive unit includes a fluid operated piston-and-cylinder unit;

said piston-and-cylinder unit including a cylinder extending transverse to the direction of movement of the pusher element and having a piston rod which is connected with the thrust and traction element.

10. The apparatus as defined in claim 9, wherein:

said cylinder stands essentially upright.

11. An apparatus for displacing three dimensional articles, especially printed products, relative to a substantially horizontal support element which can be changed in its position, comprising:

a substantially horizontal, elevationally adjustable support element;

a pusher element exerting a pushing action upon the articles to be displaced;

drive means for forwardly and rearwardly displacing the pusher element parallel to the support element and over said support element;

said pusher element, during its displacement over the support element, bearing upon said support element;

said drive means including a flexible, spatially movable thrust and traction element having a first end and a second end;

said pusher element being secured to said first end of said flexible, spatially movable thrust and traction element;

said drive means further including a drive unit connected with the other end of said flexible, spatially movable thrust and traction element;

guide means through which there is guided said flexible, spatially movable thrust and traction element;

said guide means having a stationary section and at least one section extending within the support element;

said extending section, in a rest position of the support element, being alignable with the stationary section;

said drive unit including a fluid operated piston-and-cylinder unit; and said piston-and-cylinder unit comprising an essentially upright cylinder and having a piston rod which is connected with the thrust and traction element.

* * * * *